US005460140A

United States Patent [19]

Porter

[11] Patent Number: 5,460,140

[45] Date of Patent: Oct. 24, 1995

[54] BLOCK FOR A TWO-CYCLE ENGINE

[75] Inventor: Timothy C. Porter, Ormond Beach, Fla.

[73] Assignee: Able Performance Products, Inc., Ormond Beach, Fla.

[21] Appl. No.: 278,826

[22] Filed: Jul. 22, 1994

[51] Int. Cl.[6] ..... F02F 7/00

[52] U.S. Cl. ..... 123/195 R; 123/41.74; 123/193.2

[58] Field of Search ..... 123/41.74, 65 A, 123/65 P, 65 PD, 65 W, 65 PE, 73 PP, 74 B, 195 R, 193.2

[56] References Cited

U.S. PATENT DOCUMENTS

| | | | |
|---|---|---|---|
| 2,404,404 | 8/1946 | Ryde | 123/65 A |
| 5,251,580 | 10/1993 | Torigai | 123/65 PD |

FOREIGN PATENT DOCUMENTS

| | | | |
|---|---|---|---|
| 1043913 | 11/1953 | France | 123/193.2 |
| 1039305 | 9/1958 | Germany | 123/65 W |

*Primary Examiner*—Noah P. Kamen
*Attorney, Agent, or Firm*—James H. Beusse

[57] ABSTRACT

A two-cycle engine block machined from a solid block of aluminum alloy has at least one cylinder passing through the block. An exhaust port extends from an outside surface of the block to an inside surface of the cylinder approximately midway between a top and a bottom of the cylinder. First and second fuel transfer ports are positioned on opposite sides of the cylinder and circumferentially displaced from the exhaust port. Each of the fuel transfer ports have front side walls angularly oriented so as to direct fuel toward a sidewall of the cylinder opposite the exhaust port. Each fuel transfer port has a top surface lying in a plane generally normal to an axis of the cylinder to deter upward flow of fuel into the outward flowing exhaust gases.

9 Claims, 3 Drawing Sheets

BLOCK FOR A TWO-CYCLE ENGINE

BACKGROUND OF THE INVENTION

The present invention relates to two-cycle internal combustion engines and, more particularly, to a method and apparatus for increasing horsepower without increasing RPM in a two-cycle engine.

Conventional two-cycle engine blocks used for medium to high power applications such as jet skis are cast blocks. Such engines typically produce about 50 HP at 6500 RPM. Horsepower drops down as engine speed decreases. For applications such as jet skis, it is desirable to be able to produce higher horsepower at lower engine speed but, at the same time, it is imperative that the engine be small and lightweight. While cast engines meet the small and lightweight criteria, efforts to increase horsepower often result in cracking or damage and failure of the cast block from the added stress. It is believed that such failures in cast blocks stem from the inherent difficulty in obtaining defect free castings, i.e., minute voids or imperfect grain structure are common in engine size castings.

In addition to the disadvantages of cast blocks, it has also been found that efforts to increase power output often result in "blown" head gaskets, i.e., pressure loss through leakage between the cylinder block and cylinder head. It is common in such small block engines to form the block and head from aluminum alloy. Under high temperature and stress, it is believed that the head can warp or deform thus allowing leakage between the head and block.

Still another disadvantage of the prior art cast engine blocks is in the shape and configuration of each cylinder and its associated fuel transfer passages and exhaust passages. Conventionally, the designs are optimized for ease of manufacture and the general design of such small cylinder blocks has not been changed significantly since the inception of two-cycle engines. However, such designs are not believed optimal for engine performance.

SUMMARY OF THE INVENTION

Among the several objects of the present invention may be noted the provision of a solid aluminum alloy cylinder block which overcomes the above and other disadvantages of the prior art; the provision of an improved cylinder block which minimizes blown head gaskets at high power operation; the provision of an improved cylinder blocked machined from a solid extruded block of aluminum alloy; and the provision of an improved cylinder block which provides significantly higher power at lower RPM.

In an illustrative form, the engine block of the present invention is machined from an extruded block of aluminum alloy. The fuel transfer passages are machined to create a design which directs the fuel charge into the cylinder away from the associated exhaust ports. The exhaust ports are designed to minimize turbulence of the exhaust and prevent mixing with the incoming fuel charge. The direction of flow of the incoming fuel charge is arranged to assist in exhausting burned fuel. The cylinder block includes at least two fuel transfer ports on opposite sides of each cylinder with a thin-wall divider separating each pair of transfer ports. Each fuel port is enlarged, with respect to fuel ports in an equivalent size cast cylinder block, so as to inject additional fuel into the engine.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
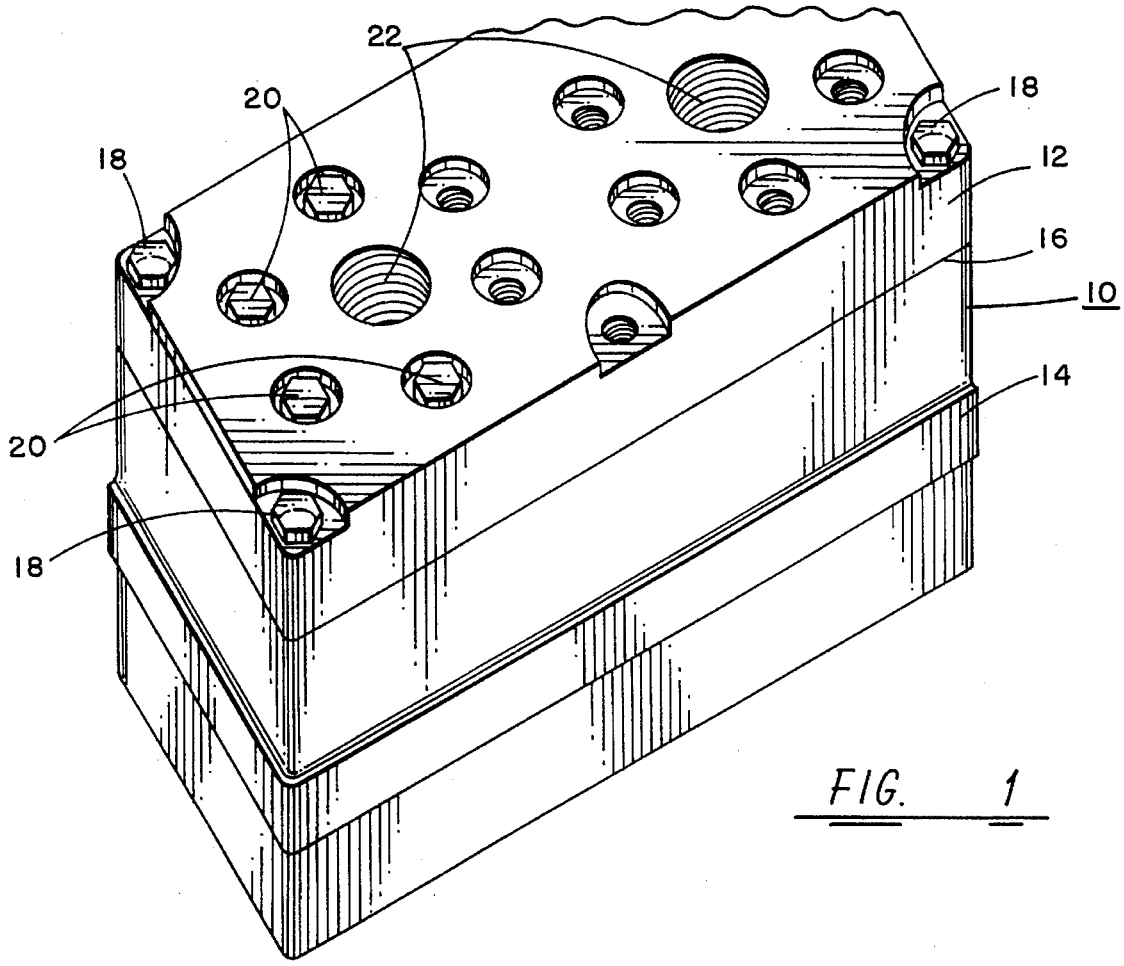
FIG. 1 is a perspective view of an exemplary two-cycle engine block and head.

FIG. 1 is a perspective view of a two-cycle engine cylinder block 10 with an associated cylinder head 12. The block 10 and head 12 are each machined from a solid block of an aluminum alloy. The aluminum alloy block may be rolled in plate form and cut into sections or extruded as bar stock. A section suitable for machining of block 10 weighs about 30 pounds. The block 10 includes a circumscribing rib 14 and separates head 12 along line 16. The head 12 is attached to block 10 by through-bolts 18 which pass through head 12 and block 10 and threadedly engage into the engine crankcase (not shown). It will be appreciated that this through-bolt design provides a better coupling between head and block as compared to other designs using threaded blocks or flanges on the blocks for holding head bolts.

In addition to the through-bolts 18, the head 2 is attached to cylinder block 10 by means of bolts 20 arranged in a pattern circumscribing each of the cylinders of block 10. The center apertures 2 are for spark plugs or igniters for the cylinders. The pattern and significance of bolts 20 in preventing blown head gaskets will be appreciated by reference to FIG. 2.

Figure 2:
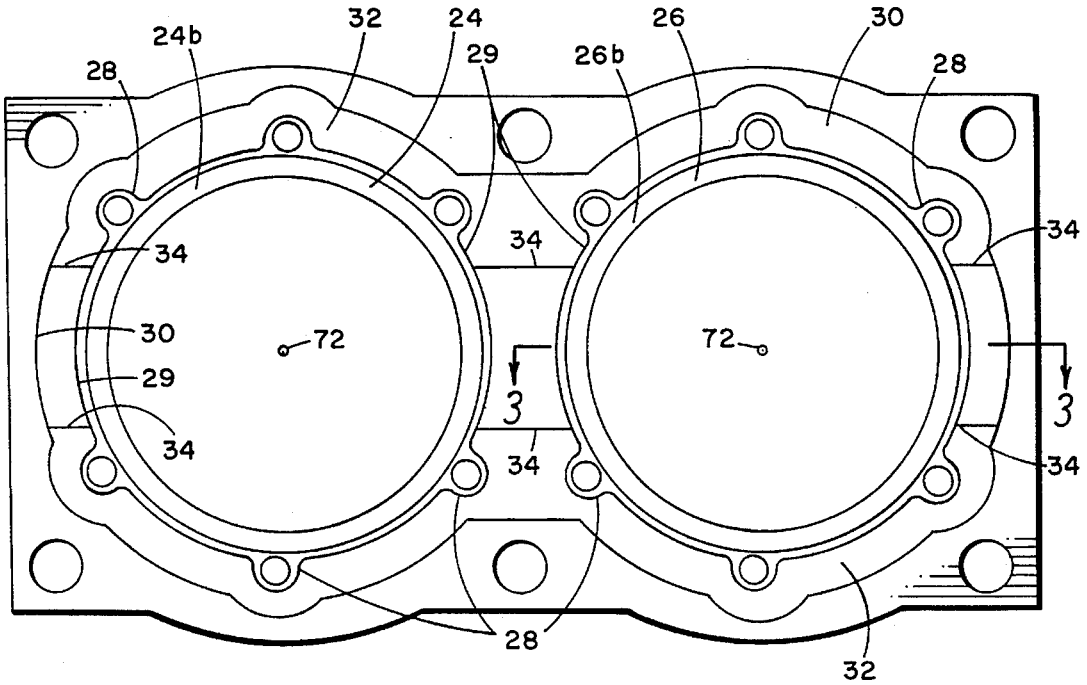
FIG. 2 is a top plan view of the inventive engine block.

Referring to FIG. 2, there is shown a top plan view of cylinder block 10 with head 12 removed. The block 10 includes a pair of cylinders 24, 26 each adapted for receiving an inner steel liner 25 (see FIG. 6). Considering FIG. 3 in conjunction with FIG. 2, in which FIG. 3 is a partial cross-sectional view taken along lines 3—3 of FIG. 2, it can be seen that each of the cylinders 24, 26 comprise an upper cylindrical section 24*a*, 26*a* for receiving a steel liner and each section has a flange receiving shoulder 24*b*, 26*b* for receiving a flange on the inserted liner.

A plurality of vertically extending ribs 28 are circumferentially spaced about each cylinder 24, 26 with the upper ends of the ribs being tapped with threaded apertures for receiving the bolts 20. It can be seen that the ribs 28 are tightly clustered about the respective cylinders in order to compress the head 12 as near as possible to the upper ends of the cylinders.

The outer side walls 29 of cylinders 24, 26 in conjunction with the outer walls 30 of the block 10 form a water jacket defining a coolant chamber 32 circumscribing the upper sections 24*a*, 26*a* of each cylinder. The chamber 32 is machined deeper along a line extending through and connecting the two cylinders as indicated by the lines 34 representing a stepped portion of the chamber.

Figure 3:
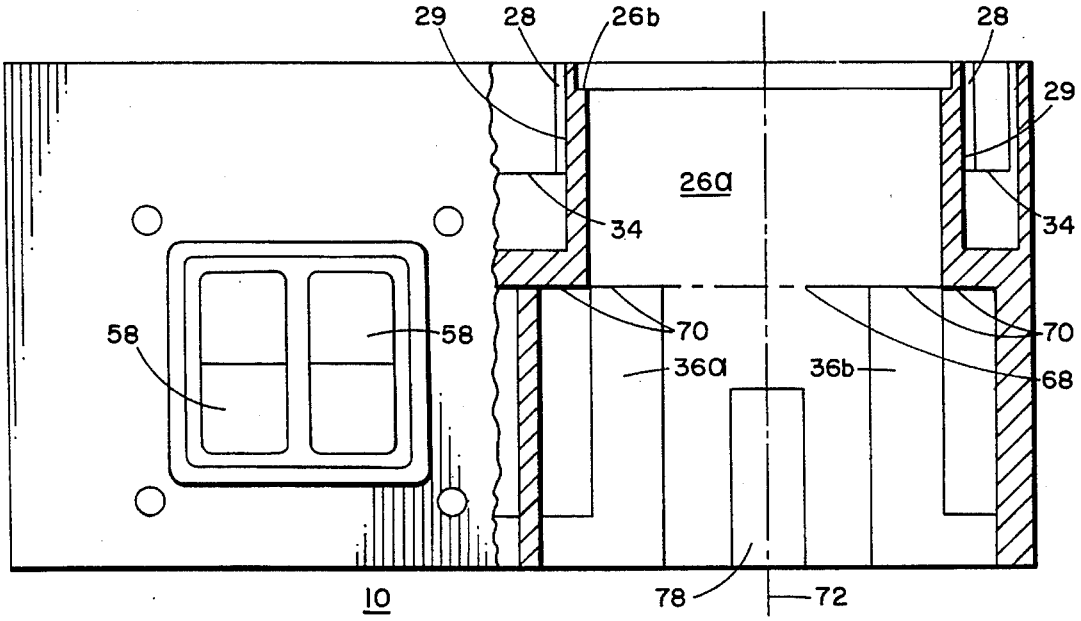
FIG. 3 is a partial cross-sectional view taken along line 3—3 of FIG. 2.
Figure 4:
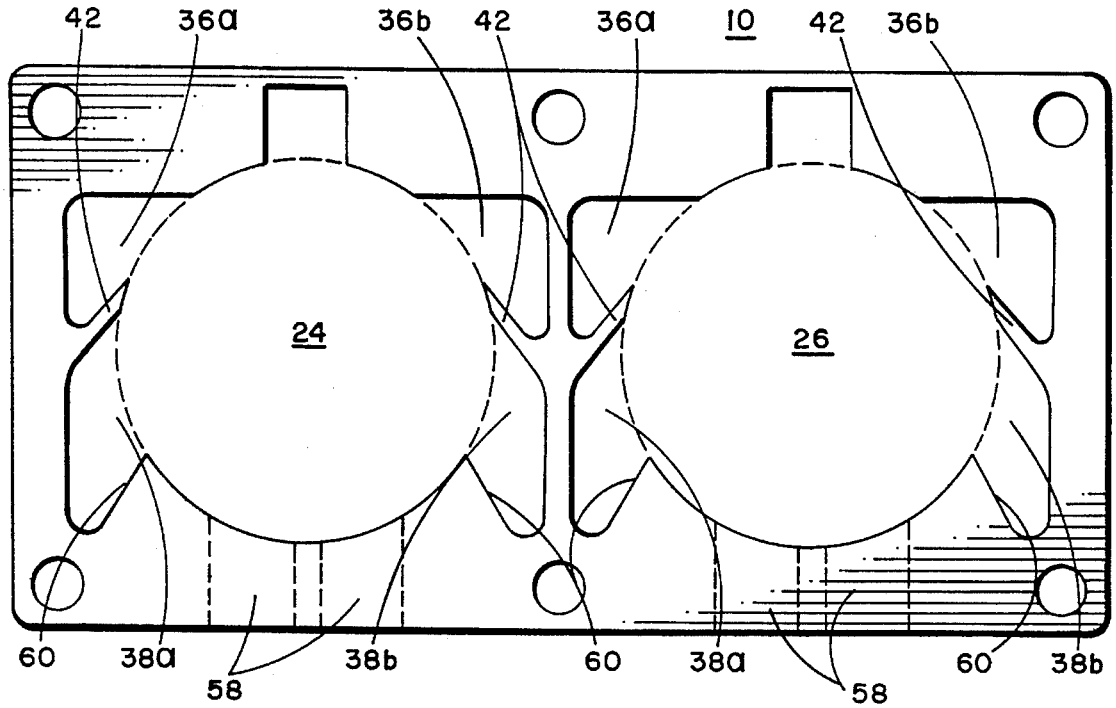
FIG. 4 is a bottom plan view of the engine block of FIG. 2.

Referring now to FIG. 4 in conjunction with FIG. 3, where FIG. 4 is a bottom plan view of cylinder block 10, it can be seen that the lower portion of cylinders 24, 26 are intersected by opposing pairs of fuel transfer ports 36*a*, 36*b* and 38*a*, 38*b*. The transfer ports 36, 38 are each distinct from ports used in prior art cylinder blocks.

Figure 5:
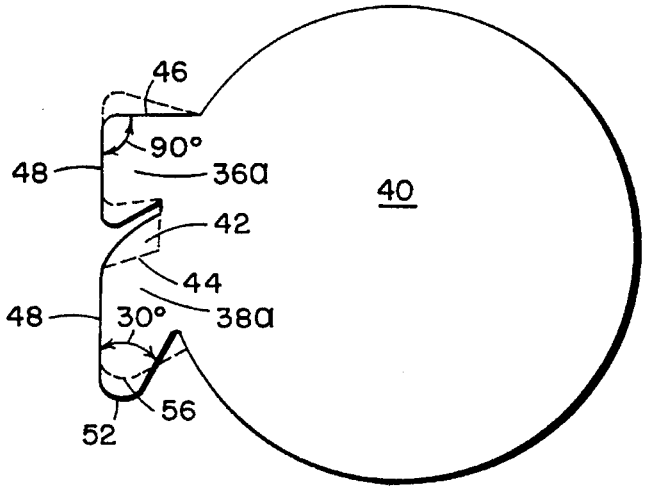
FIG. 5 is a simplified cross-sectional view taken transverse to the view of FIG. 3.

Referring to FIG. 5, there is shown a simplified view of a cylinder 40 (equivalent to cylinders 24, 26) with transfer ports 36*a*, 38*a* shown in solid lines and a typical configuration of prior art fuel transfer ports overlaid in phantom lines. It can be seen that a divider 42 between ports 36*a*, 38*a* is much wider in the prior art than in the present design. Further, the divider of the prior art extends almost along radius lines of the cylinder as shown by the phantom lines at 44. In the rear port 36*a*, the present design forms essentially a 90° angle at the intersection of rear wall 46 and outer wall 48. In the prior art, the rear wall 46 is generally formed so that the intersection of rear wall 50 and outer wall 48 is less than 90°. It is believed that such a cut-back is necessary in prior art engines in order to provide sufficient volume in port 36*a*. However, the cut-back detrimentally effects fuel transfer into the associated cylinder. In the forward fuel transfer port 38*a*, applicant forms a significantly larger cut-back area at 52 and reduces the angle between outer wall 48 and front wall 54 to about 30°. In the prior art, the front wall, represented by phantom line 56, formed about an 80° angle with outer wall 48.

In order to appreciate the significance of applicant's inventive design, it will be noted that in a two-cycle engine the burned exhaust gases are exhausted from the cylinder almost concurrently with the introduction of a fuel-air charge into the cylinder. The exhaust gases exit through exhaust ports 58, indicated by phantom lines in FIG. 4, and shown in FIG. 3, in the forward side of block 10. When the fuel-air charge in the cylinder burns and expands, the expanding gases drive a piston 55 (not shown) in cylinder 24 downward. As the top of the piston passes the exhaust ports, the pressure of the burned fuel-air charge causes a rapid flow of gases out the exhaust ports rapidly dropping the pressure in the cylinder. A fraction of a second after the top of the piston passes the top edge of the exhaust ports, the piston top passes by the top edge of the fuel transfer ports. A fuel-air mixture in the transfer ports, pressurized by compression of the volume of the crankcase area as the piston descends, begins to flow into the cylinder above the piston. The prior art design allowed the fuel-air mixture to flow in an upward direction generally across the top of the piston. As a consequence, some of the fuel-air mixture was scavenged by the exiting exhaust gases and flowed out with such gases. Other portions of the fuel-air mixture mixed with the exhaust gases and the resulting turbulence impeded the outward flow of exhaust gases causing a significant portion of the burned gases to be retained in the cylinder thereby reducing the volume of unburned fuel-air mixture and reducing the power capability of the engine.

In applicant's design, the fuel transfer ports are formed such that the forward walls 60 are angled more sharply toward the rear of the cylinder, i.e., toward the portion opposite the exhaust ports 58. In addition, the divider 42 is much thinner than the divider of the prior art, e.g., the divider is about ⅓ the width of the prior art divider. The thinner divider 42 not only increases the available volume of the transfer ports 36, 38, but it also significantly reduces the turbulence of the entering fuel-air mixture improving flow into the cylinder. Furthermore, the divider 42 is angled generally parallel to the forward walls 60 to help direct the fuel-air charge toward the rear of the cylinder. Applicant has found that by directing the flow in this manner, the fuel-air charge can be caused to flow in behind the exhaust gases acting as a motive force to expel the exhaust from the cylinder without turbulent mixing.

In addition to the angled side-walls of the fuel transfer ports, applicant has also discovered that the top surface 70 (see FIG. 3) of the ports 36, 38 should be formed generally flat, i.e., in a plane 68 normal to an axis 72 of the cylinders. Prior art systems have commonly tapered the surface 70 in an upward direction in a belief that such taper would cause the fuel-air charge to be directed upward toward the top of the cylinder. While such upward flow is produced by a tapered surface 70, applicant believes the result is increased mixing of the charge with the exhaust gases, increased turbulence in the cylinder and an increase in the amount of fuel-air charge which is scavenged from the cylinder by the exhausting gases. In contrast, by making the top 70 of the ports 36, 38 flat, the fuel-air charge enters the cylinder without any initial upward bias and is caused to flow in a near laminar manner toward that portion of the cylinder opposite the exhaust ports. When the charge flow reaches the cylinder wall, collision of flow from ports 36*a*, 38*a* with flow from ports 36*b*, 38*b* causes an upward swelling and flow of the fuel charge up the wall to the top of the cylinder and then spreads in a downward pattern effectively pushing the exhaust gases out the exhaust ports 58 with minimal mixing of the fuel-air charge with the exhaust gases. The result is that the fuel-air charge in the cylinder during the compression stroke is much richer than in prior art two-cycle engines. As an example, applicant has obtained 120 horsepower from an engine having the same displacement as a prior art engine producing only 50 horsepower at the same RPM, e.g., about 7000 RPM.

Figure 6:
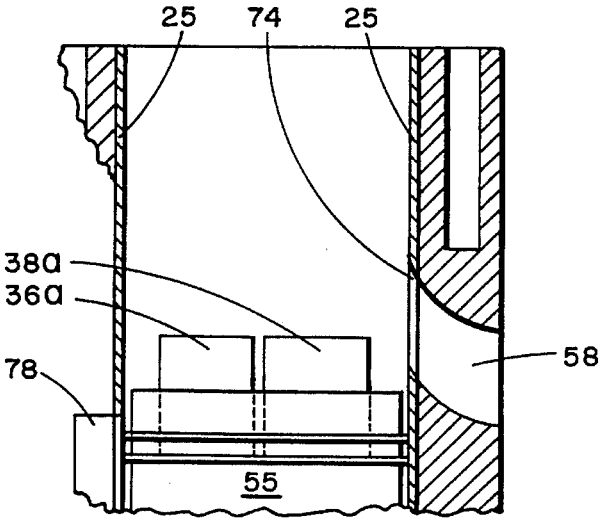
FIG. 6 is a simplified bottom plan view similar to FIG. 4 showing prior art designs compared to FIG. 4.

A further improvement in engine performance is achieved by forming or machining an upper radius 74 on the exhaust ports 58 so as to eliminate the sharp edge normally found in two-cycle engine exhaust ports. FIG. 6 illustrates the radius 74, about a one-inch radius, as compared to a conventional exhaust configuration indicated by phantom line 76. Applicant found that the sharp edge at the exhaust port, with the high pressure in the cylinder, generates turbulence in the exhaust flow which detrimentally affects removal of the exhaust from the cylinder. The radius at 74 provides a smooth transition to the exhaust port and encourages a more laminar flow of the exhaust gases out the exhaust ports. As can be seen, the upper edge of the exhaust ports 58 is higher in the cylinder than the upper edge of the fuel transfer ports 36, 38 so that the exhaust ports are exposed by downward movement of the piston prior to exposure of the fuel transfer ports. Accordingly, an outward flow of exhaust gases is established prior to the introduction of a new fuel-air charge so that pressure in the cylinder is substantially reduced when the fuel-air charge is introduced to the cylinder. It can also be seen that an additional fuel transfer port 78 (shown also in FIG. 3) in the cylinder wall opposite the exhaust ports 58 is exposed as the piston reaches the bottom of its downward stroke. The port 78 introduces additional fuel into the cylinder without any predesigned flow direction so that the additional flow does not tend to force the charge in the cylinder to flow toward the exhaust ports. The flow from port 78 tends to be along the top surface of the piston and counteracts the previously established circulating flow indicated by arrows 80, thus creating turbulence in the cylinder to better distribute the fuel-air charge.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A block for a two-cycle engine comprising:

a solid block of aluminum alloy having at least one cylinder machined in said block;

a water jacket machined about an upper portion of said cylinder; and a plurality of circumferentially spaced, axially extending ribs machined along an outer surface of said cylinder adjacent said upper portion and in said water jacket, said ribs having threaded apertures for receiving a plurality of head bolts for compressing a head over said cylinder.

2. The block of claim 1 and including at least one exhaust port machined from an outer surface of said block into said cylinder below said upper portion, said exhaust port having an upper edge at an intersection with said cylinder formed with a radiused transition from said cylinder into said exhaust port.

3. The block of claim 1 and including a plurality of fuel transfer ports machined in said block and intersecting said cylinder below said upper portion, each of said fuel transfer ports having at least a forward wall angularly machined for directing a fuel-air charge into said cylinder in a direction generally opposite said exhaust port.

4. The block of claim 3 wherein at least some of said fuel transfer ports are arranged in groups diametrically opposite one another and circumferentially displaced from said exhaust ports.

5. The block of claim 4 wherein each of said groups of fuel transfer ports includes at least two ports separated by a relatively thin wall divider, each said divider being angular oriented for directing a fuel-air charge away from said exhaust port.

6. The block of claim 5 wherein each of said fuel transfer ports is machined with a top surface lying in a plane substantially normal to an axis of said cylinder.

7. The block of claim 6 and including another fuel transfer port machined in said block and intersecting said cylinder generally diametrically opposite said exhaust port, said another fuel transfer port opening into said cylinder below said plurality of fuel transfer ports.

8. The block of claim 7 wherein each of said plurality of fuel transfer ports adjacent said another fuel transfer port is formed with a rear wall extending generally parallel to a tangent line to said cylinder at said another fuel transfer port.

9. The block of claim 8 and including a plurality of bolt holes extending through said block for coupling a head and said block to an engine crankcase on which said block is positioned by bolts passing through said block and head and threadedly coupled to the crankcase.

* * * * *